US005471864A

United States Patent [19]

Long

[11] Patent Number: 5,471,864

[45] Date of Patent: Dec. 5, 1995

[54] PARALLEL MOTION APPARATUS

[75] Inventor: Alden O. Long, Carlisle, Pa.

[73] Assignee: The Whitaker Corporation, Wilmington, Del.

[21] Appl. No.: 192,222

[22] Filed: Feb. 3, 1994

[51] Int. Cl.[6] ..... H01R 43/048

[52] U.S. Cl. ..... 72/407; 72/416; 72/450; 29/753

[58] Field of Search ..... 72/395, 402, 410, 72/450, 407, 416; 29/753, 751

[56] References Cited

U.S. PATENT DOCUMENTS

| | | | |
|---|---|---|---|
| 1,314,614 | 9/1919 | Fried | 72/410 |
| 1,328,508 | 1/1920 | Fried | 72/410 |
| 1,858,418 | 5/1932 | Rowley | 72/410 |
| 2,992,576 | 7/1961 | Evans | 72/410 |
| 3,205,568 | 9/1965 | Stull | 72/410 |
| 3,416,213 | 12/1968 | Cootes | 72/402 |
| 3,633,400 | 1/1972 | Wunder | 72/410 |

*Primary Examiner*—Daniel C. Crane

[57] ABSTRACT

A crimping apparatus is disclosed utilizing an angular motion actuator and a unique tooling bar arrangement to redirect the angular motion so that the crimping dies move along a straight line during the crimping process. Two identical tooling bars are utilized that interengage to form a sliding assembly so that the two crimping dies, formed in the tooling bars, move along the straight line. The tooling bars, which are operated by the actuator, have complementary recess and projected portions. The projected portion of each bar is nested within the recess of the other bar. Each tooling bar has an elongated opening and a pin that slidingly engages the elongated opening of the other tooling bar to limit the sliding motion to motion along a straight line.

8 Claims, 6 Drawing Sheets

PARALLEL MOTION APPARATUS

The present invention relates to apparatus for crimping, for example, a ferrule onto an electrical cable, or other related or similar manufacturing operation wherein the motion of the actuator is angular while the motion of the crimping dies is linear along a substantially straight line.

BACKGROUND OF THE INVENTION

There are a variety of crimping apparatuses known to the industry. Such crimping apparatuses range from relatively simple devices that are inexpensive to manufacture to complex, special purpose devices that are very expensive. Usually, the simpler devices employ an air cylinder as the source of power and a pair of pivoting jaws that are pivoted by extending or retracting the piston rod of the air cylinder. These angular motion crimping devices, while suitable for various general crimping operations, such as crimping hose ends onto fittings, are not always suitable for precision crimping operations such as those performed in the electrical cable and connector industries.

A well known crimping apparatus for general crimping operations is shown in FIGS. 1 and 2. The crimping apparatus, indicated as 10, includes an angular motion gripper 12, such as the style RG round body gripper manufactured by Compact Air Products, Inc., P.O. Box 439, 2424 Sandifer Blvd., Westminster S.C. 29693, and a suitable mounting bracket 14. The gripper 12 includes an air cylinder actuator 16 and a pair of jaws 18 which are pivotally attached to the frame of the actuator by the pins 20. Each jaw 18 includes a half round hole 22 in an edge so that the two half round holes are mutually opposed. The cylinder 16 has a piston rod 24 that extends outwardly and is coupled to the jaws 18 by means of a drive pin 26 that extends laterally through the piston rod and into the two opposing half round holes, as shown. When the piston rod 26 is retracted from its extended position, as shown in FIG. 1, the piston rod 24 moves toward the left causing the two jaws 18 to pivot about their respective pins 20 in the direction of the arrows 30 and 32 until they reach their closed position shown in FIG. 2. The jaws 18 include crimping dies 34 that are formed directly in their mating surfaces, however, the dies may be separate inserts that are screwed to the jaws. Note that, as the piston rod 24 begins to pivot the two jaws 18 from their open positions shown in FIG. 1, the direction of movement of the crimping dies 34 is about 30 degrees from the horizontal. That is, the dies have a vertical component moving them toward each other but they have a much larger horizontal component moving them to the left, as indicated by the arrows 36 in FIG. 1. As the piston rod 24 is extended, from the position shown in FIG. 2, the two jaws 18 pivot about their respective pins 20 in the direction of the arrows 38 and 40 until they reach their open position shown in FIG. 1. This horizontal component of motion results in the center of the crimping dies 34 being moved laterally a substantial distance between the open and closed positions. This can be undesirable when the item being crimped is held stationary by other mechanisms, such as in automated machinery where there are other work stations adjacent the crimping apparatus 10. Additionally, the horizontal component of movement of the two crimping dies 34 can adversely affect the quality of the crimp in certain applications such as when crimping a ferrule onto the shield conductor of a cable when terminating the end of the cable to an electrical connector. In such cases it is required that the two crimping dies 34 move along a substantially straight line toward each other and that the line of movement not move laterally any appreciable amount so that the cable is not damaged. The present invention provides a parallel motion apparatus for performing crimping and other manufacturing operations that meets these requirements.

SUMMARY OF THE INVENTION

An apparatus is disclosed for operating a pair of mating tools in the performance of a manufacturing operation. The apparatus includes an actuator having first and second jaws pivotally attached thereto, wherein the first and second jaws include first and second mutually opposed extended portions respectively, The jaws pivot to move the extended portions along arcuate paths toward and away from each other. A parallel motion mechanism is provided comprising a pair of substantially similar tooling bars, each having a mating tool fixed thereto. The pair of tooling bars are interengaged to undergo only mutual reciprocating motion so that the mating tools move toward and away from each other along a substantially straight line. Each of the pair of tooling bars is coupled to a respective one of the extended portions so that the movement of the extended portion along their arcuate paths toward and away from each other effects the reciprocating movement of the mating tools toward and away from each other along the substantially straight line.

DESCRIPTION OF THE PREFERRED EMBODIMENT

Figure 2:
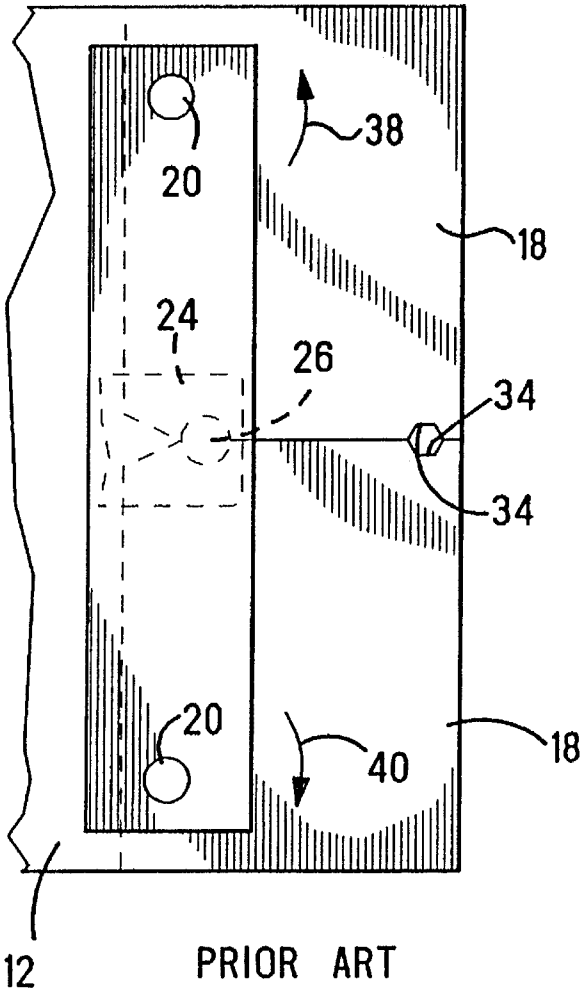
PRIOR ART FIG. 2
FIG. 2 is a partial front view of the crimping apparatus shown in FIG. 1.
Figure 1:
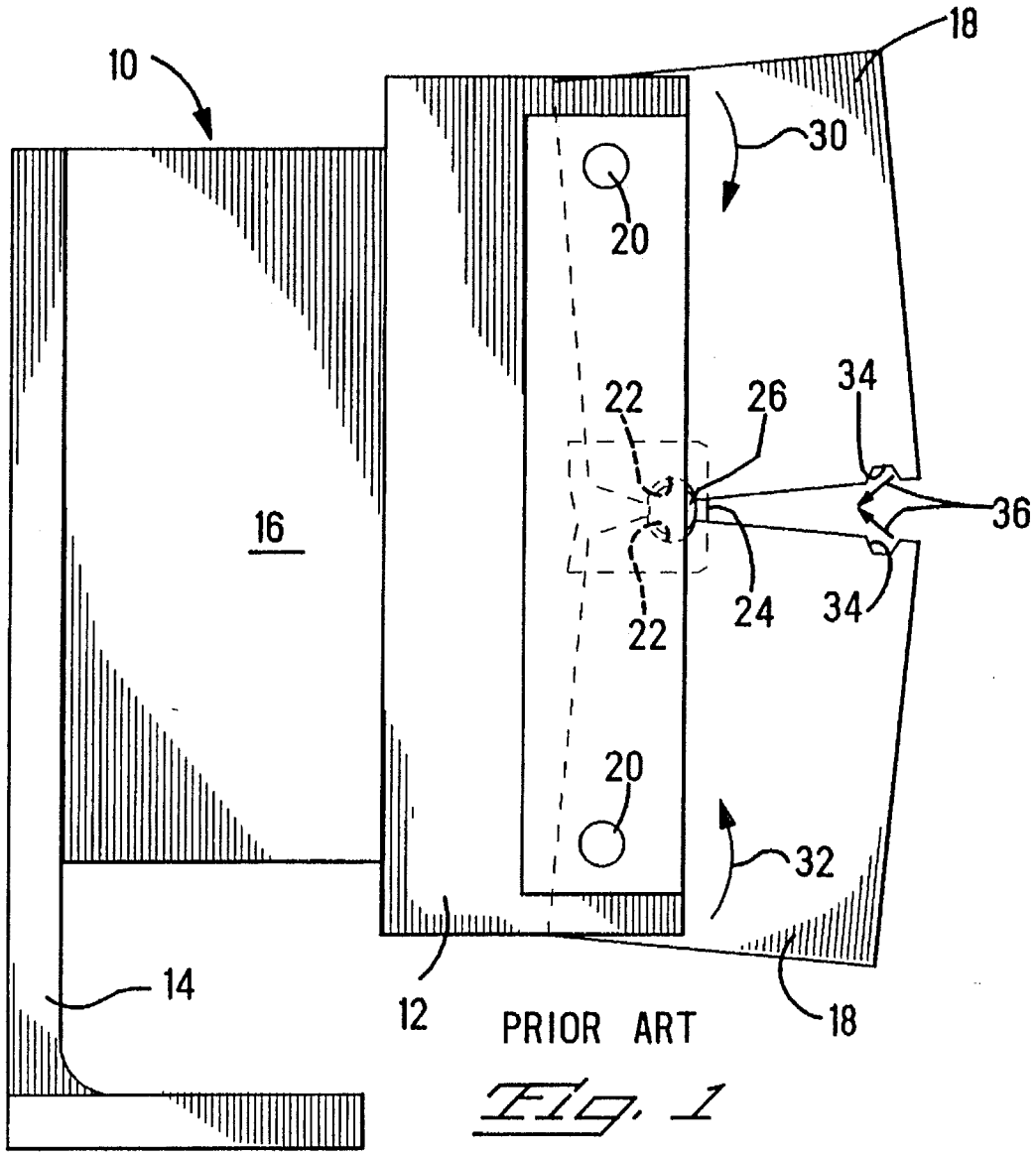
PRIOR ART FIG. 1
FIG. 1 is a front view of a prior art crimping apparatus shown in the open position.

There is shown in FIGS. 3, 4, 5, and 6 a crimping apparatus 50 including an angular motion actuator 52, an L-shaped mounting bracket 54 attached to the actuator by screws 56, and a pair of interengaged tooling bars 58 that cooperate to provide parallel motion to the crimping dies. The actuator 52 includes an air cylinder 60 and a pair of jaws 62 which are pivotally attached to the frame of the actuator by a pair of pins 64. Each jaw 62 includes a half round hole 66 in an edge so that the two half round holes are mutually opposed. The cylinder 60 has a piston rod 68 that extends outwardly and is coupled to the jaws 62 by means of a drive pin 70 that extends laterally through the piston rod and into the two opposing half round holes, as shown. When the piston rod 68 is moved from its retracted position shown in FIG. 3 to its extended position shown in FIG. 4, the piston rod 68 moves toward the right causing the two jaws 62 to pivot about their respective pins 64 in the direction of the arrows 72 and 74, respectively, until they reach their open position, shown in FIG. 4. When the piston rod 68 is moved from its extended position shown in FIG. 4 to its retracted position shown in FIG. 3, the piston rod moves toward the left causing the two jaws 62 to pivot about their respective pins 64 in the direction of the arrows 76 and 78, respectively, until they reach their closed position, shown in FIG. 3. This pivoting or angular motion of the jaws 62, as stated above, is not suitable for the present crimping operation and, therefore, must be redirected into a linear motion by the two tooling bars 58.

Figure 3:
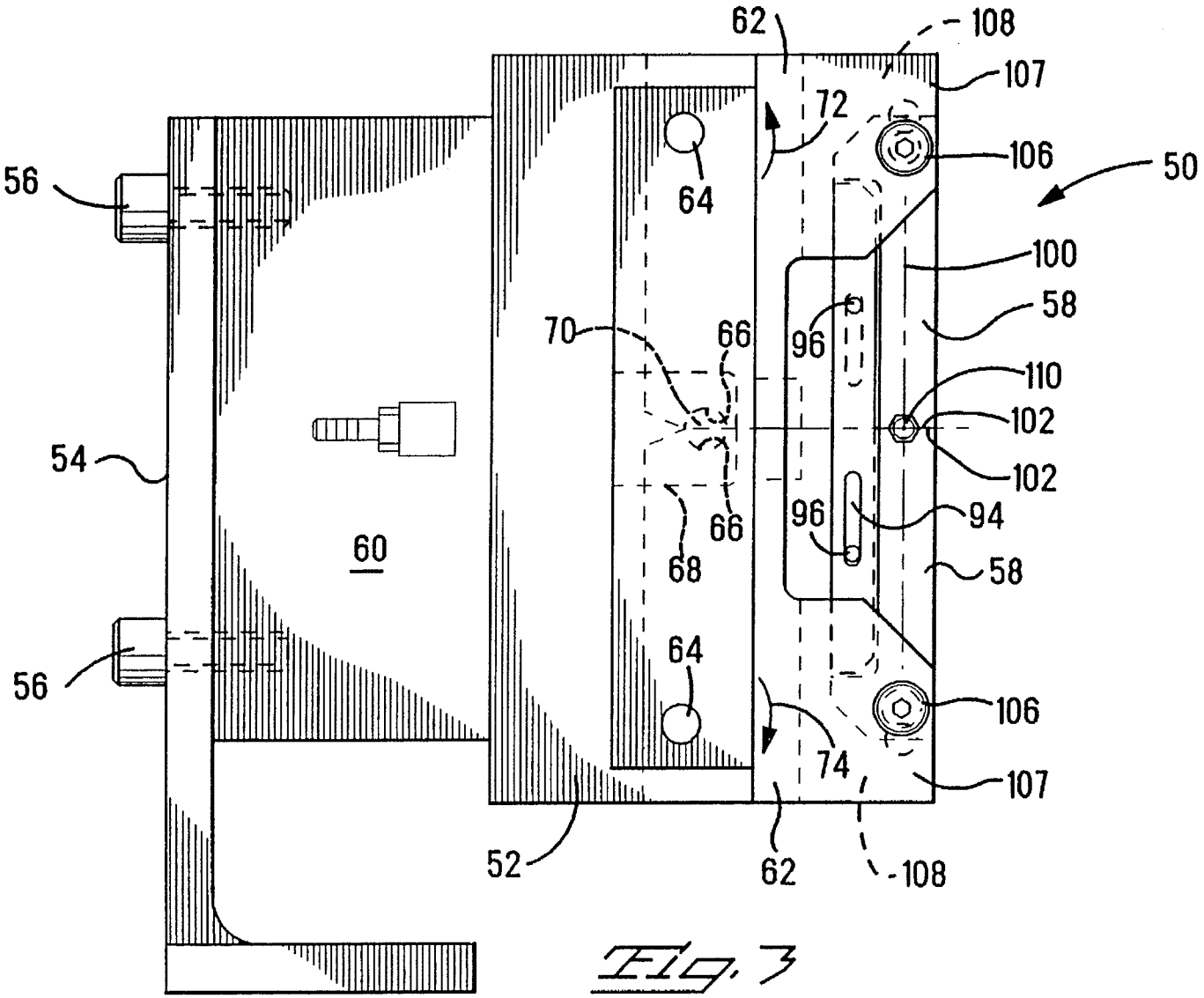
FIG. 3 is a front view of a crimping apparatus incorporating the teachings of the present invention and showing the crimping dies in their closed position.
Figure 6:
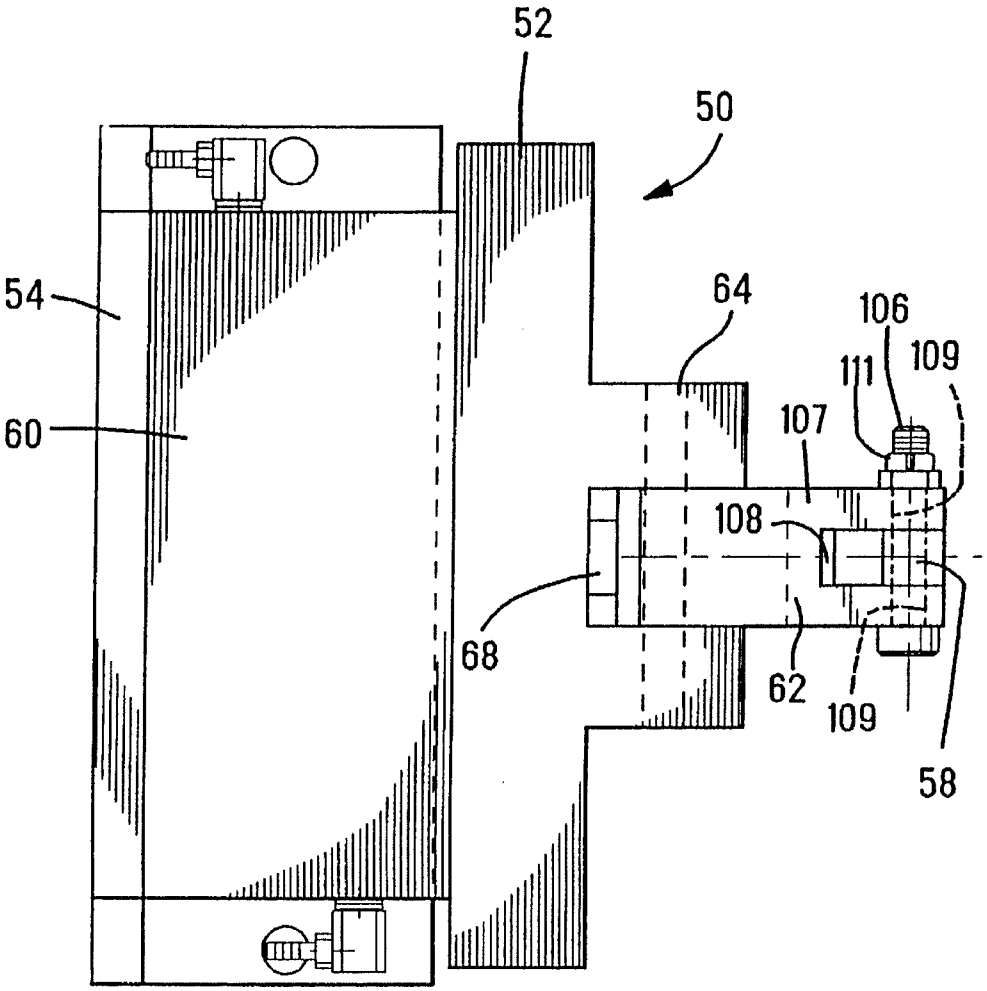
FIG. 6 is a top view of the apparatus shown in FIG. 3.
Figure 5:
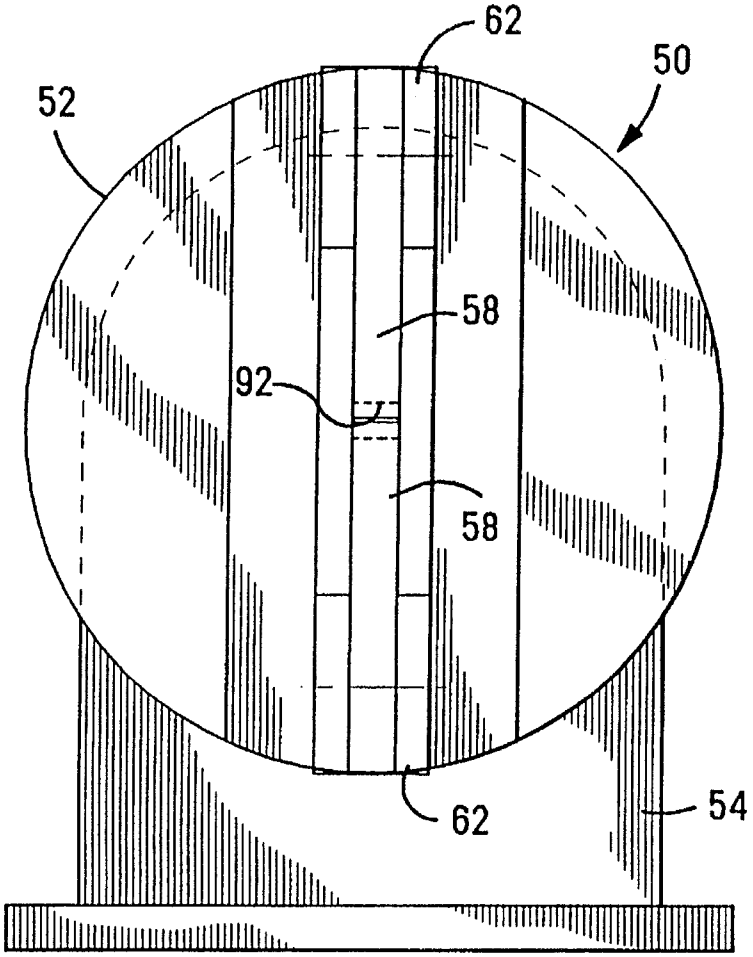
FIG. 5 is an end view of the apparatus shown in FIG. 3.
Figure 9:
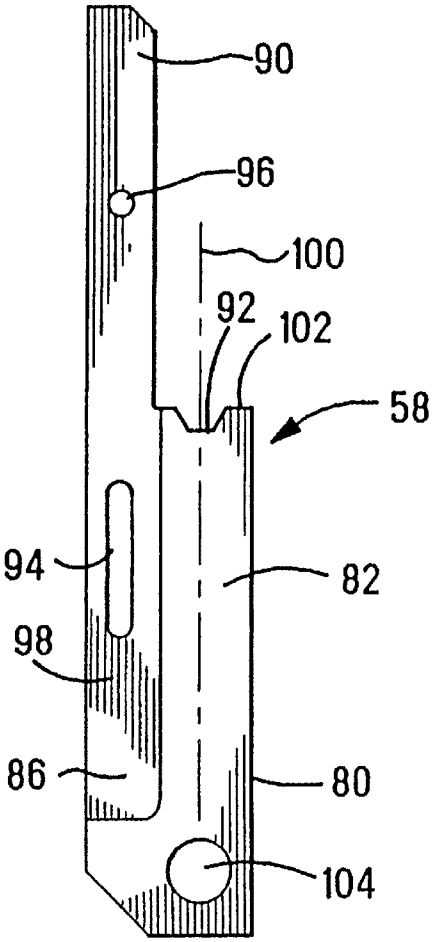
FIGS. 8 and 9 are front and side views respectively of one of the tooling bars shown in FIG. 7.
Figure 8:
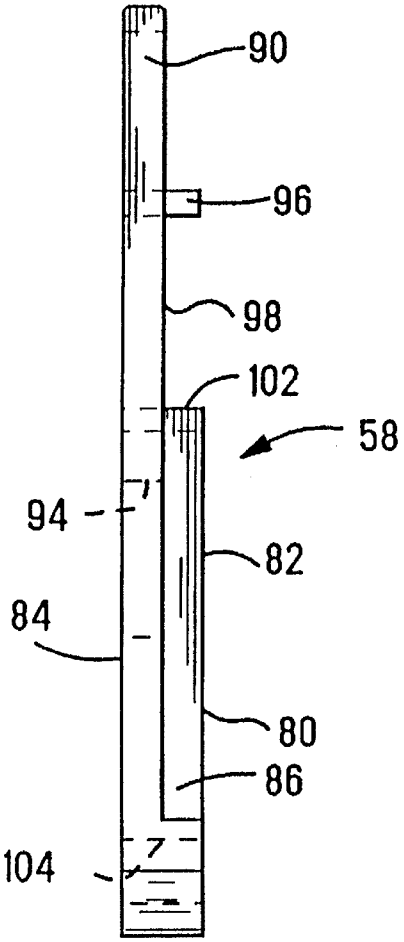
Figure 7:
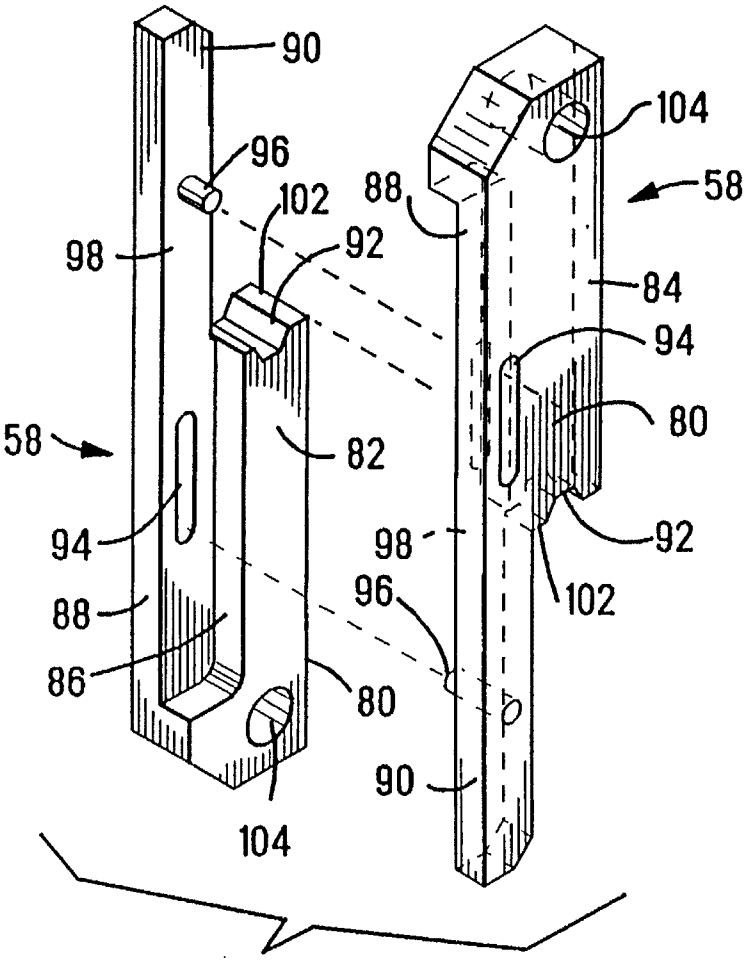
FIG. 7 is an isometric view of the two tooling bars shown in FIG. 3.

The two tooling bars 58 are identical in size and shape and interengage as shown in FIG. 7. As shown in FIGS. 7, 8, and 9, each tooling bar 58 includes a body 80 having two opposite substantially parallel sides 82 and 84. A recess 86 is formed in the surface 82 to a depth equal to one half the thickness of the body 80 thereby forming a flange 88. The flange 88 has a projected portion 90 having a width that is the same as the width of the recess 86 and that extends beyond the end of the body 80. A crimping die form 92 is arranged in the end of the body 80 adjacent the projected portion 90. The crimping die form 92, or simply crimping die, may be formed directly in the end of the body 80, as in the present example, or it may be a replaceable insert that is attached to the end of the body. The crimping dies 92 of the two tooling bars 58 mate when the two bars are interengaged to form a mating crimping die set for crimping a ferrule onto a cable, as will be explained below. An elongated opening 94 is formed in each flange 88 substantially parallel with the longitudinal axis of the flange and projected portion 90. A pin 96, having a diameter that is a slip fit with the width of the elongated opening 94, is pressed into a hole in each of the projected portions 90 along the extended center line of the elongated opening. When the two tooling bars 58 are assembled together into interengagement, each pin 96 enters a respective elongated opening 94 and each projected portion enters a respective recess 86 so that the surface 82 of each of the tooling bars 58 is flush with its corresponding surfaces 84 of the other tooling bar 58, and the two crimping dies 92 are in opposing alignment. The two facing surfaces 98 of the flanges 88 are in mutual sliding engagement with motion being limited by the pins 96 sliding within the elongated openings 94 so that the two crimping dies 92 move toward and away from each other along a substantially straight line 100, shown in FIGS. 3, 4, and 9. An end of each body 82 has an abutting surface 102 adjacent the crimping die form 92 arranged so that when the two crimping die forms 92 slide into mated engagement the two surfaces mutually abut, thereby controlling the shut height of the tool. The other end of each body 82 has a hole 104 formed therethrough having an axis that is parallel with the axis of the pin 96 and arranged to receive a shoulder screw 106. As best seen in FIGS. 3 and 6, each of the jaws 62 has an extended portion 107 that extends outwardly therefrom. A slot 108 is formed in the portion 107 having a width slightly larger than the thickness of the body 80 so that the tooling bar assembly of the two bars 58, is received within the slot with minimal lateral play. A hole 109 is formed through the portion 107 perpendicular to the slot 108 and arranged to receive the shoulder screw 106. The shoulder screws 106 extend through the holes 104 and 109 and are held in place by means of a lock nut 111. This pivotally attaches the tooling bar assembly to the two jaws 62.

Figure 4:
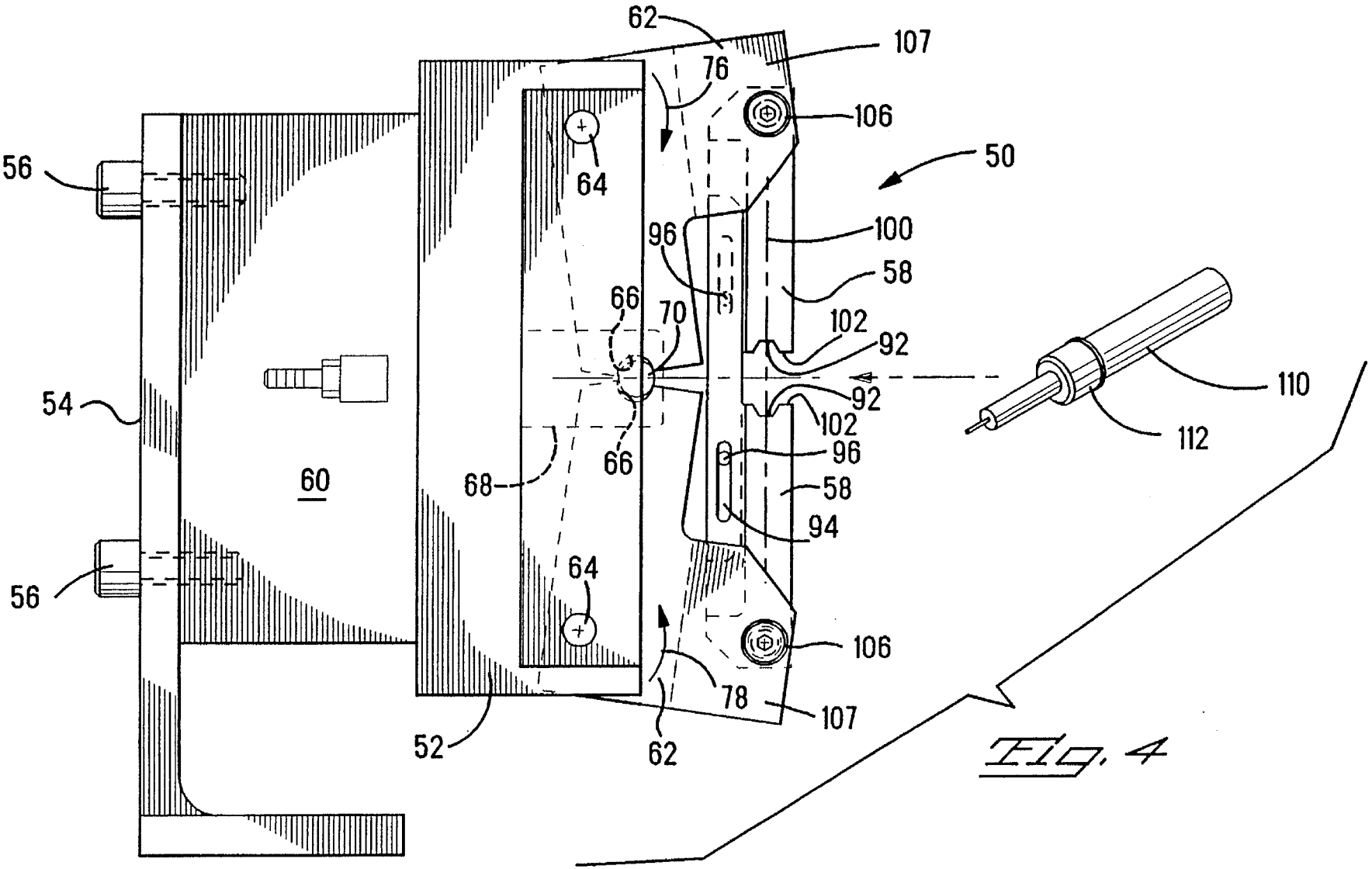
FIG. 4 is a view similar to that of FIG. 3 showing the crimping dies in their open position.

In operation, with the piston rod 68 extended and the jaws 62 in their open positions, as shown in FIG. 4, the two tooling bars 58 are also in their open positions with the crimping die forms separated and ready to receive a cable 110 and ferrule 112 to be crimped thereon. The cable and ferrule are positioned within the opening between the two crimping dies, either manually or more usually by an automated mechanism, and the piston rod 68 retracted. This causes the two jaws 62 to pivot to their closed position shown in FIG. 3. As the jaws 62 pivot the two shoulder screws 106 move closer together causing the two interengaged tooling bars 58 to slide together so that the two crimping dies 92 move toward each other along the straight line 100. As motion continues, the two crimping dies engage and crimp the ferrule 112 onto the cable 110, at which point the two surfaces 102 abut and prevent further movement of the dies toward each other. The piston rod 68 is then extended causing the jaws 62 to pivot to their open positions and the two tooling bars 58 to slide to their open positions shown in FIG. 4. The terminated cable 110 is then removed and the process repeated as desired.

As the actuator 52 moves the jaws and the tooling bars 58 from their open positions to their closed positions, the straight line 100 that represents the track of the crimping dies 92 moves laterally, with respect to the actuator, very slightly. This lateral movement is due to the arcuate motion of the shoulder screws 106 pivoting about the pins 64. The amount of lateral movement, however, is only about 0.0043 inch when considering the entire movement of the tooling bars 58 between their fully open and fully closed positions. It will be appreciated, however, that a portion of this movement is slack movement as the crimping dies 92 move toward engagement with the ferrule 112 and cable 110. Therefore, when considering only the movement of the crimping dies 92 between the point of first engagement with the ferrule and the point where the surfaces 102 are in abutting engagement, the lateral movement of the tracking line 100 is about 0.003 inch. This small amount of lateral movement is well within the tolerance allowed by most automated machinery for such an operation. It will be noted that, because the sides 82 and 84 of the body 80 are parallel, the crimping forces are transmitted from the crimping dies 92 directly to the shoulder screws 106. Such a structure obviates the need for toggles, in line slide mechanisms, or other extraneous mechanisms that would tend to introduce additional friction into the apparatus.

Figure 11:
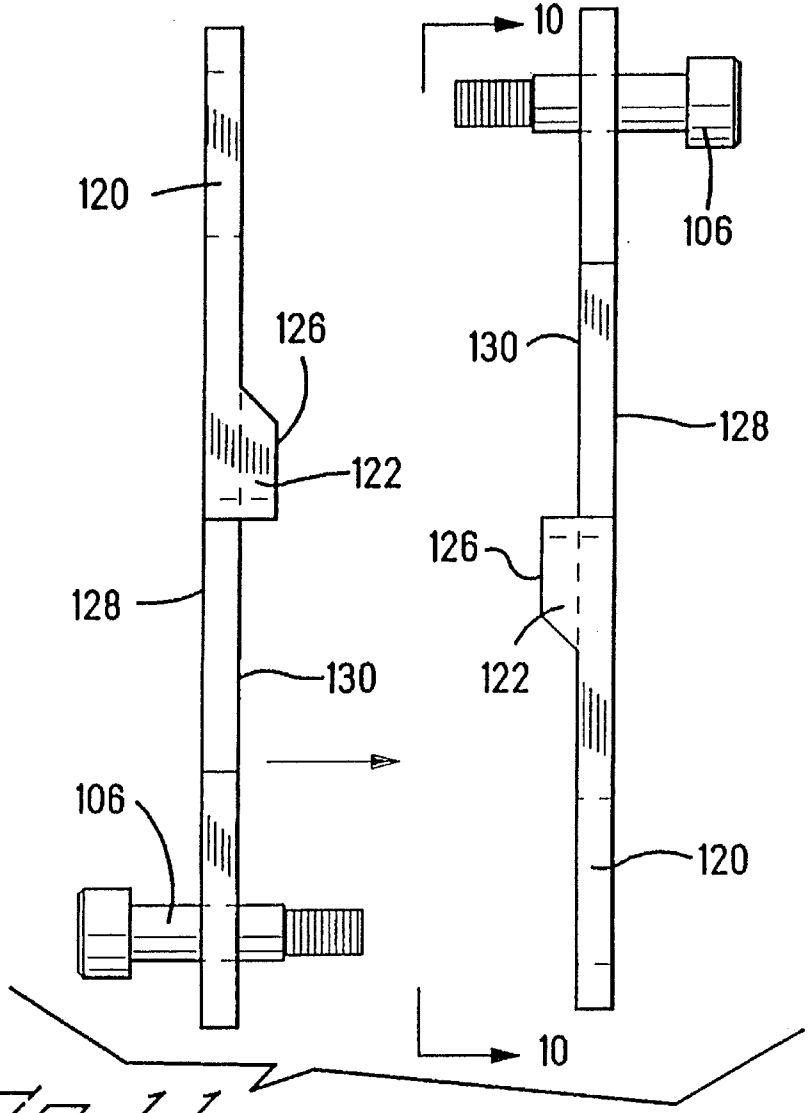
FIG. 11 is a side view showing a pair of the tooling bars of FIG. 10 just prior to interengagement.
Figure 10:
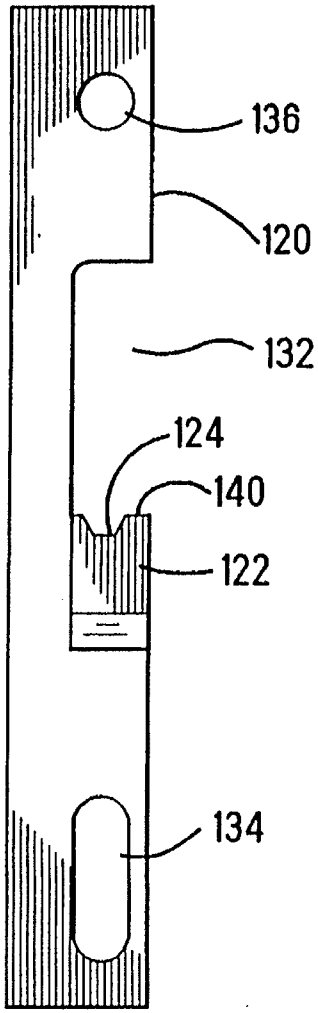
FIG. 10 is a front view of a second embodiment of a tooling bar incorporating the teachings of the present invention.

A second embodiment of the present invention utilizes a pair of tooling bars 120 shown in FIGS. 10 and 11. The bar 120 includes a body portion 122 having a crimping die form 124 in the end thereof. The remainder of the tooling bar 120 has a reduced thickness that is substantially one half the thickness of the body portion so that when the two tooling bars 120 are interengaged, the surfaces 126 of the side of each body portion 122 is flush with a respective outer surface 128 of the other tooling bar. When interengaged the inner surfaces 130 of each of the tooling bars are in mutual sliding engagement and the two crimping dies 124 are in opposing alignment. As best seen in FIG. 10 the tooling bar 120 includes a cutout 132 for receiving the body portion 122 of the other tooling bar and providing sufficient clearance during operation of the mechanism. An elongated opening 134 is provided near one end of the tooling bar 120 and a hole 136 near the other end. The elongated opening 134 and hole 136 are arranged along the longitudinal axis of the tooling bar 120 and sized to be a slip fit with the shoulder screws 106 that are used to pivotally attach the tooling bars 58 to the jaws 62 in the first embodiment. Unlike the first embodiment, however, the shoulder screws 106 in the second embodiment extend through the hole 136 in one of the bars 120 and through the elongated opening 134 in the other bar, and through the hole 109 in the jaws 62 to pivotally attach the tooling bar assembly to the jaws. The combined thickness of the tooling bar assembly is received within the slots 108 of the jaws 62 without appreciable lateral play in a manner similar to the first embodiment. In operation, motion of the two tooling bars 120 is limited by the shoulder screws 106 sliding within the elongated openings 134 so that the two crimping dies 124 move toward and away from each other along a substantially straight line. Opposite to the motion of the crimping dies 92 of the first embodiment, when the piston rod 68 of the second embodiment is extended the crimping dies 124 move to their closed position and when the piston rod is retracted the two crimping dies move to their open position. An end of each body 122 has an abutting surface 140 adjacent the crimping die form 124 arranged so that when the two crimping die forms 124 slide into mated engagement the two surfaces mutually abut, thereby controlling the shut height of the tool.

The parallel motion mechanism of the present invention, while described above in the context of performing a crimping function, is suitable for performing other manufacturing operations requiring linear movement of a pair of mating tools toward and away from each other such as wire cutting and insulation stripping operations. It may be particularly advantageous to fit the bars 58 or 120 with removable die inserts, not shown, that perform the desired operation. This would then allow the same parallel motion mechanism to be used for a variety of manufacturing operations.

An important advantage of the present invention is that the crimping dies move along a substantially straight line during the crimping process thereby providing a superior crimp. Lateral movement of the cable during the crimping operation is maintained within limits acceptable to most automated machine environments. Additionally, the tooling bar assembly is composed of two identical tooling bars, thereby reducing the cost to manufacture the apparatus.

I claim:

1. In an apparatus for operating a pair of mating tools in the performance of a manufacturing operation wherein the apparatus includes an actuator having first and second jaws pivotally attached thereto, said first and second jaws including first and second mutually opposed extended portions respectively, wherein, upon operation of said actuator, said jaws pivot thereby moving said extended portions along arcuate paths toward and away from each other, a parallel motion mechanism comprising:

a pair of tooling bars coupled to respective ones of said extended portions, each of said tooling bars having a mating tool fixed thereto, said pair of tooling bars being coupled to each other for mutual reciprocating motion by a laterally extending pin of each said tooling bar which is in sliding engagement with an elongated opening of its respective other said tooling bar, wherein said movement of said extended portions along said arcuate paths toward and away from each other effects reciprocating movement of said mating tools toward and away from each other along a substantially straight line.

2. The apparatus according to claim 1 wherein said coupling of each of said tooling bars is effected by each of said tooling bars being pivotally attached to a respective one of said extended portions.

3. The apparatus according to claim 2 wherein said coupling is a shoulder screw extending through a said tooling bar and into threaded engagement with a hole in a respective said extended portion.

4. The apparatus according to claim 3 wherein a portion of each tooling bar has a thickness that is substantially one half the thickness of the remaining portion and wherein said one half thick portions are in sliding engagement.

5. A crimping apparatus for crimping a first body onto a second body comprising:

(a) an actuator having first and second jaws pivotally attached thereto, said first and second jaws including first and second mutually opposed extended portions respectively, wherein, upon operation of said actuator, said jaws pivot thereby moving said extended portions along arcuate paths toward and away from each other; and (b) a pair of crimp bars coupled to respective ones of said extended portions, each of said crimp bars having a mating crimp die, said pair of crimp bars being coupled to each other for mutual reciprocating motion by a laterally extending pin of each said crimp bar which is in sliding engagement with an elongated opening of its respective other said crimp bar, wherein said movement of said extended portions along said arcuate paths toward and away from each other effects reciprocating movement of said mating crimp dies toward and away from each other along a substantially straight line.

6. The apparatus according to claim 5 wherein said coupling of each of said crimp bars is effected by each of said crimp bars being pivotally attached to a respective one of said extended portions.

7. The apparatus according to claim 6 wherein the centers of said pivotal attachment of said crimp bars to said extended portions define said substantially straight line and wherein each of said pair of crimp bars includes two opposite parallel surfaces extending from said pivotal attachment to said crimp die so that compressive forces resulting from the crimping operation are transferred directly along said crimp bar to said pivotal attachment.

8. The apparatus according to claim 7 wherein a portion of each crimp bar has a thickness that is substantially one half the thickness of the remaining portion and wherein said one half thick portions are in sliding engagement.

* * * * *